United States Patent [19]

DiGeronimo

[11] 4,424,188

[45] Jan. 3, 1984

[54] STERILIZATION OF PACKAGING MATERIAL

[75] Inventor: Michael J. DiGeronimo, Chester, N.Y.

[73] Assignee: International Paper Company, New York, N.Y.

[21] Appl. No.: 336,212

[22] Filed: Dec. 31, 1981

[51] Int. Cl.[3] ..... A61L 2/10; A61L 2/08

[52] U.S. Cl. ..... 422/20; 422/24; 422/300

[58] Field of Search ..... 422/20, 24, 300, 302, 422/304, 128

[56] References Cited

U.S. PATENT DOCUMENTS

| | | | |
|---|---|---|---|
| 2,138,839 | 12/1938 | Chambers . | |
| 2,417,722 | 3/1947 | Wolff . | |
| 2,578,673 | 12/1951 | Cushman . | |
| 2,647,846 | 8/1953 | Bagno | 134/1 |
| 2,717,874 | 9/1955 | Verain . | |
| 2,746,193 | 5/1956 | Billian . | |
| 2,904,392 | 9/1959 | Pomerantz et al. . | |
| 3,091,901 | 6/1963 | Silverstolpe . | |
| 3,230,137 | 1/1966 | Ellison | 162/161 |
| 3,248,841 | 5/1966 | Heffelfinger et al. | 53/29 |
| 3,305,130 | 2/1967 | Meek | 221/175 |
| 3,385,570 | 5/1968 | Pijls et al. . | |
| 3,481,687 | 12/1969 | Fishman . | |
| 3,513,627 | 5/1970 | Poucette et al. | 422/24 X |
| 3,672,823 | 6/1972 | Boucher | 422/20 |
| 3,697,222 | 10/1972 | Sierra . | |
| 3,708,263 | 1/1973 | Boucher . | |
| 3,737,608 | 6/1973 | Nagao . | |
| 3,789,569 | 2/1974 | Egger | 53/28 |
| 3,884,012 | 5/1975 | Ernestsson et al. | 53/22 |
| 3,904,361 | 9/1975 | Egger . | |
| 3,912,450 | 10/1975 | Boucher | 422/20 |
| 3,929,409 | 12/1975 | Buchner et al. . | |
| 3,970,426 | 7/1976 | Stark et al. . | |
| 3,994,686 | 11/1976 | Rauser et al. . | |
| 4,035,981 | 7/1977 | Braun et al. . | |
| 4,121,107 | 10/1978 | Bachmann | 250/455 |
| 4,175,140 | 11/1979 | Bachmann et al. | 426/399 |
| 4,193,818 | 3/1980 | Young et al. | 134/1 |
| 4,211,744 | 7/1980 | Boucher | 422/20 |
| 4,289,728 | 9/1981 | Peel et al. | 422/24 |
| 4,366,125 | 12/1982 | Kodera et al. | 422/24 X |
| 4,375,145 | 3/1983 | Mosse et al. | 53/425 |

FOREIGN PATENT DOCUMENTS

| | | | |
|---|---|---|---|
| 2019704 | 7/1970 | France | 422/128 |
| 671922 | 5/1952 | United Kingdom | 422/128 |
| 2040150 | 8/1980 | United Kingdom | 422/20 |

OTHER PUBLICATIONS

M. G. Boucher; "Ultrasonics–A Tool . . . Dental Practice"; Canadian Journal of Pharmeceutical Science; vol. 14, No. 1,-1979, pp. 1–12.

R. M. G. Boucher; "Advances in Sterilization Techniques", American Journal of Hospital Pharmacy; vol. 29; pp. 660–672; 8/72.

*Primary Examiner*—Barry S. Richman

*Attorney, Agent, or Firm*—Richard J. Ancel

[57] ABSTRACT

A method for sterilizing packaging material, the packaging material being employed subsequent to its sterilization for the aseptic packaging of foodstuffs. The method includes the steps of (1) first subjecting the packaging material to ultrasonic vibrations through a liquid medium, and (2) then subjecting the packaging material to ultraviolet radiation. The bactericidal effect of steps (1) and (2) combined together as a sequence in the order recited is greater than if practiced in the reverse order. The process of this invention can be applied to a moving web of packaging material. The moving web, after its sterilization treatment, can be fed through known machinery for forming, filling, and sealing of aseptic packages for foodstuffs.

56 Claims, 2 Drawing Figures

STERILIZATION OF PACKAGING MATERIAL

This invention relates to aseptic packaging and more particularly to a method or process for sterilizing packaging material which is used to form packages for the aseptic packaging of foodstuffs. Such packaging material is often a paperboard laminate including, by way of example only, layers of paperboard, aluminum foil, and polyethylene.

Thermal treatment prior to filling is the generally accepted practice for sterilizing metal cans and glass containers for an aseptic packaging process. Most other packaging materials, such as plastics or combinations of plastics and paper, are unstable at high temperatures, thus necessitating the use of alternative sterilizing techniques and procedures. One common alternative is the use of hydrogen peroxide and heat. See, for example, U.S. Pat. No. 3,904,361 to Egger. Two sterilization methods which have been in use are ultraviolet radiation and ultrasonic sound waves, the sound waves being transmitted through a liquid.

The biocidal activity of ultraviolet radiation (UV) in the range of between 250 and 270 nm (nanometers) is well known. There are presently two widely used sources of such light commercially available. One type is the conventional germicidal lamp, and the other type is a high-intensity lamp. Of the former, there are several types commercially available. One is General Electric's lamp model G30T8. A high-intensity lamp which has been marketed recently by Brown Boveri Corporation (BBC) of Switzerland is a UV lamp operable in the C region of the UV spectrum and emits energy essentially in the region of 254 nm.

The ultraviolet spectrum is conventionally divided into three regions, known as the A, B, and C regions, with the C region being the predominately biologically active region. Measurement of UV is by the intensity of radiation expressed in microwatts per $cm^2$ (1 $uW/cm^2 = 10$ ergs/sec/$cm^2$). Dosage is expressed as the product of intensity and exposure time, in seconds or minutes, yielding microwatts per seconds/minutes per $cm^2$ (1 uW sec/$cm^2 = 10$ ergs/$cm^2$). The dose is usually measured by the use of a light sensitive paper. The biological efficiency is measured using a bioassay in which the surviving microorganisms are enumerated after irradiation.

The application of UV irradiation as a sterilant is not novel. See, for example, U.S. Pat. Nos. 3,091,901 to Silverstolpe and 4,175,140 to Bachmann et al. Such radiation has been used commercially to sterilize air, surfaces, and more recently, packaging material for foodstuffs and liquids. Ultraviolet light has also been used for the direct irradiation of rooms such as operating rooms and microbiology laboratories to control surface and airborne bacterial and fungal contamination. The above-noted BBC UV-C region lamp is currently being used in Europe, for example, to sterilize various container pouches and cups in the aseptic packaging of food products.

The use of ultrasonics in the hospital and dental fields over the last two decades has been extensive as a means of improving biocidal efficacy of sterilants. There has been a wide range of application, including use in diagnostic techniques, disinfecting of surgical instruments, and descaling of teeth. Examples of the use of ultrasonics for the washing of glass containers is shown in U.S. Pat. No. 3,302,655 to Sasaki. The use of ultrasonics for cleaning human hands is shown, for example, in U.S. Pat. No. 3,481,687 to Fishman. The use of ultrasonics is also known as part of a process (also employing hydrogen peroxide) for sterilizing packaging material in the form of a web, being shown, for example, in U.S. Pat. No. 3,929,409 to Buchner.

Although ultraviolet and ultrasonic irradiation, individually, are capable of substantially reducing the numbers of viable microorganisms on a solid surface, a practical limitation of each is its inherent sterilizing capacity and the length of time required to produce the desired effect. It has now been found, however, that when UV is applied immediately after sonication of a paperboard laminate surface, the time required for kill is greatly reduced, resulting in an efficient sterilization technique. Other advantages of this sterilization process relate to its use in the sterilization of materials that are incompatible with chemical sterilants or in the sterilization of materials without use of any chemical sterilants, which chemical sterilants may have undesirable properties.

IN THE DRAWINGS

EXAMPLE

Figure 1:
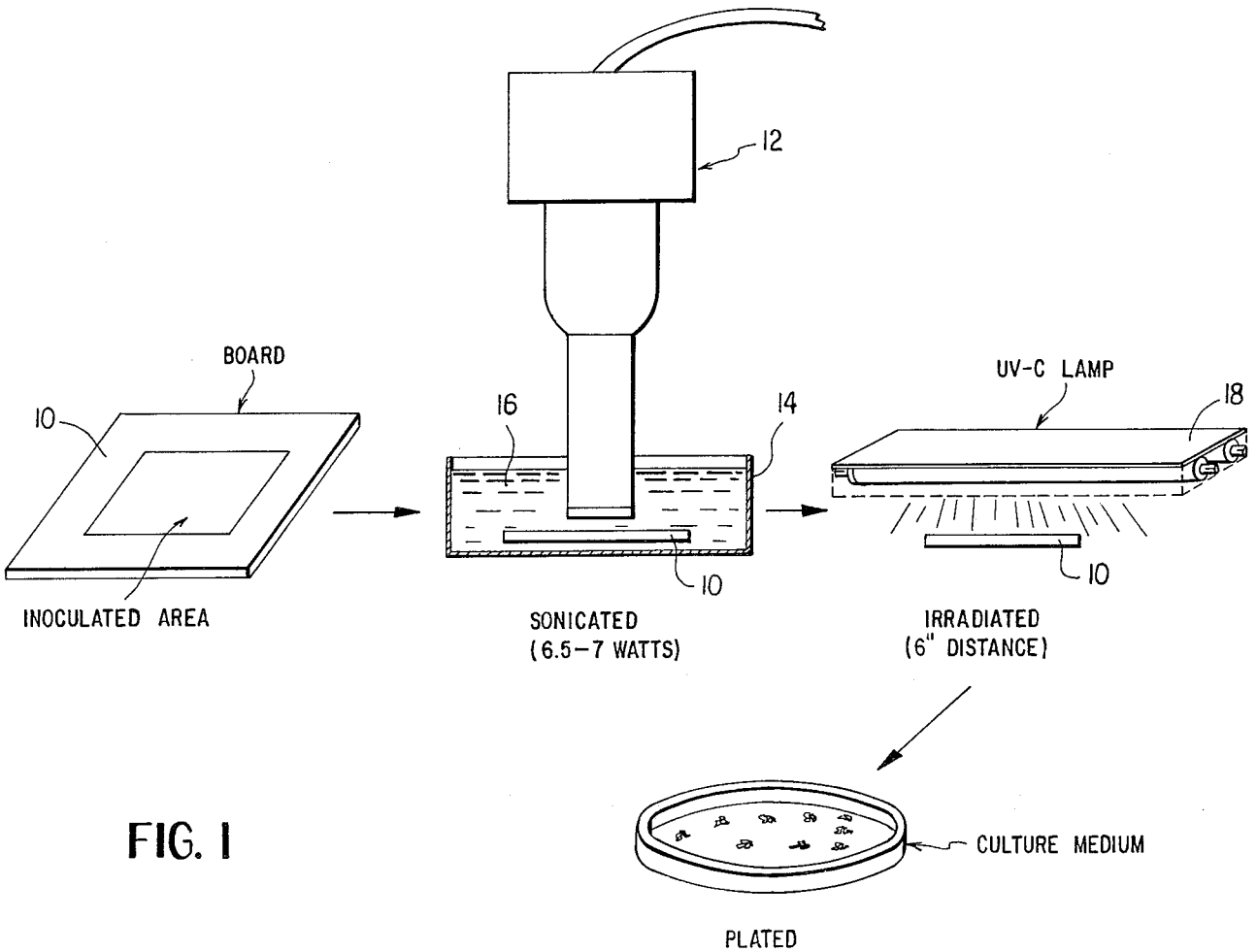
FIG. 1 illustrates the basic steps of the aseptic sterilization process of the invention.

Referring now to FIG. 1, the organism used was *Bacillus subtilis* vv *niger*. It was grown on Nutrient Agar (Difco) slants containing 1.5% soil extract. The slants were incubated at 35° C. for 4–5 days until maximum sporulation was achieved. Sporulation was determined using the cold spore stain method of Bartholomew and Mittiwer.

A Heat Systems Sonicator Model W-375 was used for the sonication portions of the experiments. This instrument operates at a sonication frequency of 20 KHz with 375 watts maximum power output. The tip used was a ½" disruptor horn.

A high intensity ultraviolet lamp marketed by Brown Boveri Corporation (BBC) of Switzerland was used. The type used was Brown Boveri Irradiation Unit UV-C 13–50. It consists of lamp type X1 2–50 inserted in a water-tight housing containing a reflector and means of water cooling. A quartz glass window permits UV radiation to be transmitted in one direction only. It operates at 99.9% efficiency at 254 nm.

A stabilized solution of 30% hydrogen peroxide (Target, electronic grade) was used for experiments involving the use of hydrogen peroxide and heat.

The test boards 10 were inoculated on one surface with 20 ul of the spore suspension, giving a $10^8$ inoculum and were allowed to dry for 30 minutes. After drying, the boards were subjected to sonication by sonicator 12. The sonication, unless otherwise stated, was at a power level of 6.5 to 7 watts for a duration of 15 seconds. The sonication was carried out in a sterile petri dish 14 using sterile distilled water 16 as the sonication medium. After sonication, the excess moisture was removed and the board was then placed on a stage under a UV lamp 18, of the BBC type 13–50 earlier described, a distance of 6" from the light surface and irradiated for a given time, usually 15 seconds.

In order to determine the number of surviving organisms, the board was sonicated for a second time. The sonication liquid was plated out in the appropriate culture medium to give a cell count of the survivors. All plates were incubated at 35° C. for 48 hours. Counts were made at 24 and 48 hours.

For $H_2O_2$ and hot air treatment, the boards were inoculated with 20 μl of spore suspension to give a $10^8$ spore concentration. The boards were allowed to dry approximately 30 minutes before treatments.

The boards 10 were immersed for 10 seconds in 30% $H_2O_2$ and the excess peroxide solution was removed. The board was then held under a hot air gun for 8 seconds. The temperature varied from 150° to 155° C. After exposure to hot air, the board was rinsed with sterile distilled water then sonicated in sterile distilled water at 7 watts for 15 seconds to remove all remaining cells. The rinse liquid and sonication liquid were plated out using Plate Count Agar (Difco). The plates were incubated at 35° C. for a total of 48 hours. Plate counts were performed at 24 and 48 hours.

TREATMENT OF ORGANISMS

The material used for all tests was laminated, foil-lined, polyethylene coated board, which is used commonly for the packaging of juices and juice drinks. The laminate construction was as follows: (low density) polyethylene (external layer)/paperboard/Surlyn-/aluminum foil/Surlyn/(low density) polyethylene (internal layer). (Surlyn is DuPont's trademark for an ionically cross-linked thermoplastic resin that is derived from ethylene/methacrylic acid copolymer). The board was cut into pieces 4.5–5.0 $cm^2$. The inoculation site was an area 1.5 $cm^2$ in the center of the board. Twenty μl of a $10^{10}$ cell suspension was used to give a $10^8$ inoculum per site. The suspension was distributed as evenly as possible over the area with a rubber policeman and allowed to dry for approximately 30 minutes before testing. After each test, cell counts were performed to determine the number of survivors. Counts were done on either sonication liquid or sterile water used to rinse the treated boards.

Initially, the effect of sequenced exposure was investigated to determine the order and contribution of ultraviolet and ultrasonic irradiation in sterilization. The results in Table 1 show that when the packaging material is challenged with $10^8$ spores and exposed to sonication only, the log reduction in organisms is 0.5 as compared to a 2.9 reduction with ultraviolet light exposure.

TABLE 1

THE EFFECT OF SEQUENCE ON THE BACTERICIDAL PROPERTIES OF ULTRAVIOLET IRRADIATION AND SONICATION

| TREATMENT | INITIAL BACTERIAL CHALLENGE | FINAL BACTERIAL LOAD | LOG REDUCTION |
|---|---|---|---|
| SONICATION | $3.77 \times 10^8$ | $1.06 \times 10^8$ | 0.5 |
| UV-C | $1.31 \times 10^8$ | $1.48 \times 10^5$ | 2.9 |
| SONICATION + UV-C | $1.98 \times 10^8$ | $8.03 \times 10^2$ | 5.4 |
| UV-C + SONICATION | $1.98 \times 10^8$ | $3.28 \times 10^5$ | 2.8 |

Significantly greater reductions were observed when inoculated boards were exposed to 15 sec. of sonication followed by 15 sec. of ultraviolet irradiation resulting in a 5.4 log reduction in viable organisms. When the inverse treatment was employed, the results were similar to UV treatment alone. To determine the reproducibility of the sterilization method, inoculated boards were exposed to 15 sec. of ultrasonic vibration followed by 15 sec. of UV irradiation on five different days. UV alone was the control. The results in Table 2 show a consistent day to day reduction of the inoculated spores to the level of $10^2$ organisms, an average log reduction of 5.1 which is approximately twice the effect of UV alone. (This turned out to be 2.5 log reduction greater than spores subjected to only UV irradiation.)

TABLE 2

THE EFFECT OF ULTRAVIOLET IRRADIATION + SONICATION ON THE SURVIVAL OF *B. subtilis* vv niger spores; 5 DAY STUDY

| TREATMENT | INITIAL BACTERIAL CHALLENGE | FINAL BACTERIAL LOAD | LOG REDUCTION |
|---|---|---|---|
| SONICATION + UV-C | $2.37 \times 10^7$ | $5.89 \times 10^2$ | 4.6 |
| SONICATION + UV-C | $2.40 \times 10^7$ | $1.78 \times 10^2$ | 5.1 |
| SONICATION + UV-C | $1.31 \times 10^8$ | $7.59 \times 10^2$ | 5.2 |
| SONICATION + UV-C | $1.98 \times 10^8$ | $8.03 \times 10^2$ | 5.4 |
| SONICATION + UV-C | $2.90 \times 10^8$ | $1.79 \times 10^3$ | 5.2 |
| AVERAGE | $1.33 \times 10^8$ | $8.24 \times 10^2$ | 5.1 |
| STD | 0.52 | 0.36 | |

A comparison of the bacterial killing action of hydrogen peroxide ($H_2O_2$), hydrogen peroxide plus heat, ultraviolet light, and sonication plus ultraviolet light was made. When hydrogen peroxide was the common sterilant used for sterilization, *Bacillus subtilis* spores were exposed to hydrogen peroxide and heated for 9 seconds to less than 100° C. (to prevent melting of the polyethylene layer). This resulted in a subsequent 5.8 log reduction in viable cells (Table 3).

TABLE 3

A COMPARISON OF THE BACTERIAL KILLING ACTION OF HYRODGEN PEROXIDE ($H_2O_2$), ULTRAVIOLET IRRADIATION AND ULTRAVIOLET IRRADIATION + SONICATION

| TREATMENT | INITIAL BACTERIAL CHALLENGE | FINAL BACTERIAL LOAD | LOG REDUCTION |
|---|---|---|---|
| 30% $H_2O_2$ | $5.8 \times 10^8$ | $1.1 \times 10^8$ | 0.7 |
| 30% $H_2O_2$ + HEAT | $5.8 \times 10^8$ | $8.71 \times 10^2$ | 5.8 |
| HEAT | $5.8 \times 10^8$ | $5.82 \times 10^7$ | 0.9 |
| UV-C | $3.77 \times 10^8$ | $1.56 \times 10^5$ | 3.4 |
| SONICATION + UV-C | $3.77 \times 10^8$ | $1.95 \times 10^3$ | 5.3 |

Neither hydrogen peroxide nor heat alone had a significant effect on the test organism. Again, sonication in combination with ultraviolet light showed a substantial decrease in the viable cells when compared to UV alone.

When the bacterial spores were subjected to various intensities of ultrasonic energy and times of exposure in combination with UV of 10 sec., time did not show any effect on the bactericidal efficiency of the method (Table 4).

TABLE 4

THE LOGARITHMIC REDUCTION OF *B. subtilis* vv niger[1] spores WHEN EXPOSED TO VARIOUS SONICATION INTENSITIES AND TIMES OF EXPOSURE[2]

| | EXPOSURE TIME | | |
|---|---|---|---|
| WATTS | LOG REDUCTION 1 SEC. | LOG REDUCTION 10 SEC. | LOG REDUCTION 60 SEC. |
| 0.7 | 4.9 | 4.8 | 4.6 |
| 110 | 5.7 | 5.7 | 5.4 |

TABLE 4-continued

THE LOGARITHMIC REDUCTION OF *B. subtilis* vv niger[1] spores WHEN EXPOSED TO VARIOUS SONICATION INTENSITIES AND TIMES OF EXPOSURE[2]

| | EXPOSURE TIME | | |
|---|---|---|---|
| WATTS | LOG REDUCTION 1 SEC. | LOG REDUCTION 10 SEC. | LOG REDUCTION 60 SEC. |
| 145 | 5.6 | 5.0 | 5.3 |

[1]Initial inoculum = $3.6 \times 10^8$
[2]UV exposure time 10 sec.

Intensity did affect the killing efficiency. There was a significant increase in the log reduction between 0.7 watts and 110 watts with no apparent difference between the higher intensities used.

The length of time of ultraviolet light exposure was shown to be a significant variable (Table 5).

TABLE 5

THE LOGARITHMIC REDUCTION[1] of *B. subtilis* vv niger spores WHEN EXPOSED TO VARIOUS UV TIMES WITH SONICATION[2]

| TIME UV | LOG REDUCTION |
|---|---|
| 2 sec. | 4.1 |
| 5 sec. | 4.4 |
| 10 sec. | 5.1 |
| 15 sec. | 5.0 |

[1]Initial inoculum average = $3.4 \times 10^8$
[2]Time of sonication exposure was 15 seconds at 6.5 to 7.0 watts There was a gradual increase in the killing action of ultraviolet light and sonication as the dose increased to 10 seconds.

The BBC UV unit 13–50, above-described, was employed in the tests summarized at Tables 1 to 8.

Figure 2:
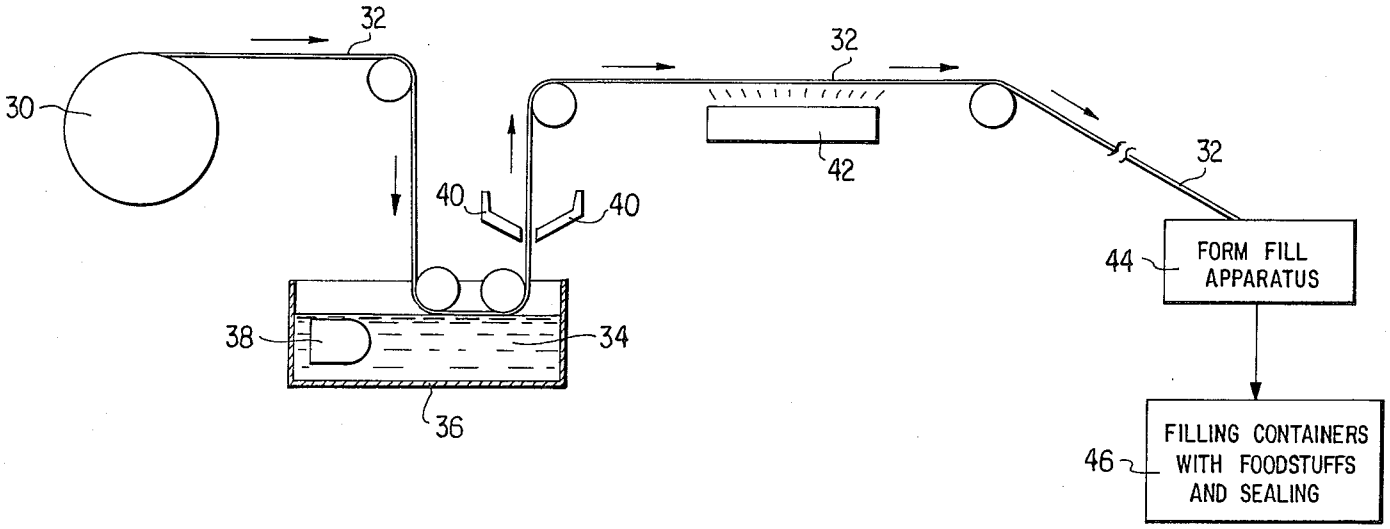
FIG. 2 illustrates how the process of this invention may be applied to a continuous process for the sterilization of a web of material, which is subsequently formed into individual containers for foodstuffs.

FIG. 2 of the drawings illustrates how the invention may be applied to a continuous process for the sterilization of a web of packaging material for foods or the like, wherein, in a form-fill apparatus, the packaging material is formed into individual containers, filled and sealed, all in an aseptic process.

In FIG. 2, the numeral 30 denotes a roll of web material 32, such as a roll of a laminate of the type previously described. After coming off of the supply roll 30, the moving web 32 would pass around rollers into and out of a liquid bath 34 in which ultrasonic energy would be radiated through the liquid by means of a sonicator 38 or by a sonicated bath (not shown) contained in vat 36. Preferably, at least the surface of the web 32, which will form the inner, food-contacting surfaces of the container, will be exposed to the sonic energy, although it is possible that the entire web could be exposed to the sonic energy. The sonicated web would then be dried, as, for example, by means of air knives 40. It will be apparent that drying means other than air knives could be employed at this stage of the operation. It is also apparent that sonicator 38 corresponds to sonicator 12 of FIG. 1 of the drawings. After passing up and out of the liquid bath 34 subsequent to ultrasonic treatment by sonicator 38 and dried by air knives 40, the moving web 32 would pass near a source of ultraviolet light denoted by the numeral 42. Element 42 of FIG. 2 corresponds to element 18 of FIG. 1. Thereafter, the web 32 would pass into a form-fill apparatus which, in general, forms tubes from the web, fills them with a sterile food product, and cuts and seals them to form individual containers 46 of an aseptically packaged product. One form-fill system is illustrated in U.S. Pat. No. 3,709,569.

Generally speaking, the present invention is directed to a method for sterilizing packaging material, the packaging material being employed subsequent to its sterilization for the aseptic packaging of foodstuffs. The method includes the steps of (1) first subjecting the packaging material to ultrasonic vibrations through a liquid medium, and (2) then subjecting the packaging material to ultraviolet radiation, whereby the bactericidal effect of steps (1) and (2) combined together as a sequence in the order recited is greater than if practiced in the reverse order.

What is claimed is:

1. A chemical biocide-free method for sterilizing packaging material, the packaging material being employed subsequent to its sterilization for the aseptic packaging of foodstuffs, the method including the steps of (1) first subjecting the packaging material to ultrasonic vibrations through a liquid medium, said liquid medium being substantially free of chemical biocidally active material, and (2) then subjecting the packaging material to ultraviolet radiation, whereby the bactericidal effect of steps (1) and (2) combined together as a sequence in the order recited is greater than if practiced in the reverse order.

2. The method of claim 1 wherein said step (1) is carried out at a sonication frequency of 20 KHz.

3. The method of claims 1 or 2 wherein said step (1) is carried out at a power level in the range of 0.7 to 145 watts.

4. The method of claim 3 wherein said step (1) is carried out at a power level of about 6.5 to 7 watts.

5. The method of claim 3 wherein said step (1) is carried out for a duration in the range of 1–60 seconds.

6. The method of claim 5 wherein said step (1) is carried out for a duration of about 15 seconds.

7. The method of claim 5 wherein said step (2) is carried out with ultraviolet radiation in the range of 250–270 nanometers.

8. The method of claim 7 wherein said step (2) is carried out with ultraviolet radiation at a wavelength 254 nanometers.

9. The method of claim 7 wherein said step (2) is carried out for a duration in the range of 2–15 seconds.

10. The method of claim 9 wherein said step (2) is carried out for a duration of 10 seconds.

11. The method of claim 10 wherein said packaging material is a laminate which includes at least one layer of paperboard.

12. The method of claim 11 wherein said laminate comprises a first layer of a thermoplastic material, a layer of paperboard, a second layer of a thermoplastic material, a layer of metallic foil, a third layer of a thermoplastic material, and a fourth layer of a thermoplastic material.

13. The method of claim 12 wherein said first and fourth layers of thermoplastic materials are comprised of polyethylene.

14. The method of claim 13 wherein said second and third layers of thermoplastic material comprise an ionically cross-linked thermoplastic resin.

15. The method of claim 1 wherein said packaging material is in the form of a moving web of indefinite length.

16. The method of claim 15 wherein said moving web is a laminate which includes at least one layer of paperboard.

17. The method of claim 16 wherein said laminate comprises a first layer of a thermoplastic material, a layer of paperboard, a second layer of a thermoplastic material, a layer of metallic foil, a third layer of a thermoplastic material, and a fourth layer of a thermoplastic material.

18. The method of claim 17 wherein said first and fourth layers of thermoplastic materials are comprised of polyethylene.

19. The method of claim 18 wherein said second and third layers of thermoplastic material comprise an ionically cross-linked thermoplastic resin.

20. The method of claim 1 wherein the liquid medium of step (1) is water.

21. A chemical biocide-free method for continuously sterilizing a packaging material in the form of a moving web of indefinite length, wherein said packaging material is employed subsequent to its sterilization to form a sealed package for the aseptic packaging of foodstuffs, the method including the steps (1) first sonicating at least one surface of the web by subjecting it to ultrasonic vibrations through a liquid medium, said liquid medium being substantially free of chemical biocidally active material, and (2) then irradiating the sonicated surface of the web by subjecting it to ultraviolet radiation, whereby at least one of said sonicated and irradiated surfaces of said web will form the interior, foodstuff-contacting surfaces of the sealed package to thereby provide an aseptic foodstuff package and whereby the bactericidal effect of steps (1) and (2) combined together as a sequence in the order recited is greater than if practiced in the reverse order.

22. The method of claim 21 wherein said step (1) is carried out at a sonication frequency of about 20 KHz.

23. The method of claims 21 and 22 wherein said step (1) is carried out at a power level in the range of 0.7 to 145 watts.

24. The method of claim 23 wherein said step (1) is carried out at a power level of about 6.5 to 7 watts.

25. The method of step 23 wherein said step (1) is carried out for a duration in the range of 1–60 seconds.

26. The method of claim 25 wherein said step (1) is carried out for a duration of about 15 seconds.

27. The method of claim 25 wherein said step (2) is carried out with ultraviolet radiation in the wavelength range of 250–270 nanometers.

28. The method of claim 27 wherein said step (2) is carried out with ultraviolet radiation at a wavelength of 254 nanometers.

29. The method of claim 28 wherein said packaging material is a laminate which includes at least one layer of paperboard.

30. The method of claim 29 wherein said laminate comprises a first, inner layer of a thermoplastic material, a layer of paperboard, a second layer of a thermoplastic material, a layer of metallic foil, a third layer of a thermoplastic material, and a fourth, exterior layer of a thermoplastic material.

31. The method of claim 30 wherein said first and fourth layers of thermoplastic materials are comprised of polyethylene.

32. The method of claim 31 wherein said second and third layers of thermoplastic material comprise an ionically cross-linked thermoplastic resin.

33. The method of claim 21 wherein the liquid medium of step (1) is water.

34. The method of claims 21 or 33 wherein said step (2)is carried out for a duration in the range of 2–15 seconds.

35. The method of claim 34 wherein said step (2) is carried out for a duration of 10 seconds.

36. A chemical biocide-free method for sterilizing packaging material, the packaging material being employed subsequent to its sterilization for the aseptic packaging of foodstuffs, the method including the steps of (1) first subjecting the packaging material to ultrasonic vibrations through a liquid medium for between 1 to 60 seconds, said liquid medium being substantially free of chemical biocidally active material, wherein the intensity of said ultrasonic vibrations is in the range of 0.7 to 145 watts, and (2) then subjecting the packaging material to ultraviolet radiation for between 2 to 15 seconds, wherein said ultraviolet radiation is emitted in the range of 250 to 270 nanometers, whereby the bactericidal effect of steps (1) and (2) combined together as a sequence in the order recited is greater than if practiced in the reverse order.

37. The method of claim 36 wherein said step (1) is carried out at a sonication frequency of about 20 KHz.

38. The method of claim 36 or 37 wherein said step (1) is carried out at a power level of about 6.5 to 7 watts.

39. The method of claim 38 wherein said step (1) is carried out for a duration of about 15 seconds.

40. The method of claim 39 wherein said step (2) is carried out with ultraviolet radiation at a wavelength of 254 nanometers.

41. The method of claim 40 wherein said packaging material is a laminate which includes at least one layer of paperboard.

42. The method of claim 41 wherein said laminate comprises a first layer of a thermoplastic material, a layer of paperboard, a second layer of a thermoplastic material, a layer of metallic foil, a third layer of a thermoplastic material, and a fourth layer of a thermoplastic material.

43. The method of claim 42 wherein said first and fourth layers of thermoplastic materials are comprised of polyethylene.

44. The method of claim 43 wherein said second and third layers of thermoplastic material comprise an ionically cross-linked thermoplastic resin.

45. The method of claim 36 wherein the liquid medium of step (1) is water.

46. A chemical biocide-free method for continuously sterilizing a packaging material in the form of a moving web of indefinite length, wherein said packaging material is employed subsequent to its sterilization to form a sealed package for the aseptic packaging of foodstuffs, the method including the steps of (1) first subjecting one surface of the web to ultrasonic vibrations through a liquid medium wherein the intensity of said vibrations is in the range of 0.7 to 145 watts and wherein said vibrations are carried out for between 1–60 seconds, said liquid medium being substantially free of chemical biocidally active material; and (2) then subjecting the said one surface of the web to ultraviolet radiation for between 2 to 15 seconds, wherein said ultraviolet radiation is emitted in the range of 250 to 270 nanometers, whereby said one surface of said web will form the interior, foodstuff-contacting surfaces of the sealed package and whereby the bactericidal effect of steps (1) and (2) combined together as a sequence in the order recited is greater than if practiced in the reverse order.

47. The method of claim 46 wherein said step (1) is carried out at a sonication frequency of about 20 KHz.

48. The method of claims 46 or 47 wherein said step (1) is carried out at a power level of about 6.5 to 7 watts.

49. The method of claim 48 wherein said step (1) is carried out for a duration of about 15 seconds.

50. The method of claim 49 wherein said step (2) is carried out with ultraviolet radiation at a wavelength of 254 nanometers.

51. The method of claim 50 wherein said web of packaging material is a laminate which includes at least one layer of paperboard.

52. The method of claim 51 wherein said laminate comprises a first, inner layer of a thermoplastic material, a layer of paperboard, a second layer of thermoplastic material, a layer of metallic foil, a third layer of a thermoplastic material, and a fourth, exterior layer of a thermoplastic material.

53. The method of claim 52 wherein said first and fourth layers of thermoplastic materials are comprised of polyethylene.

54. The method of claim 53 wherein said second and third layers of thermoplastic material comprise an ionically cross-linked thermoplastic resin.

55. The method of claim 46 wherein the liquid medium of step (1) is water.

56. The method of claim 55 wherein said step (2) is carried out for a duration of 10 seconds.

* * * * *